United States Patent [19]

Ivey, Jr.

[11] 4,029,569

[45] June 14, 1977

[54] PROCESS FOR RECLAIMING SPENT MOTOR OIL

[75] Inventor: Herbert D. Ivey, Jr., Pasadena, Calif.

[73] Assignee: Lubrication Company of America, Los Angeles, Calif.

[22] Filed: Sept. 16, 1975

[21] Appl. No.: 613,932

[52] U.S. Cl. ..... 208/180; 208/181

[51] Int. Cl.[2] ..... C10M 11/00

[58] Field of Search ..... 208/179–181

[56] References Cited

UNITED STATES PATENTS

| | | | |
|---|---|---|---|
| 1,792,882 | 2/1931 | Wischin | 208/181 |
| 2,339,520 | 1/1944 | Riesmeyer | 208/181 |
| 3,282,827 | 11/1966 | Crysiak | 208/180 |
| 3,305,478 | 2/1967 | Gilson et al. | 208/180 |
| 3,790,474 | 2/1974 | Moffitt | 208/179 |

*Primary Examiner*—Delbert E. Gantz
*Assistant Examiner*—James W. Hellwege
*Attorney, Agent, or Firm*—Lyon & Lyon

[57] ABSTRACT

Spent motor oil can be reclaimed by a process comprising heating the oil to cause precipitation of a portion of the suspended solids and then treating the oil after separation from the solids with up to about 6% by volume of concentrated sulfuric acid to complete precipitation of the solids. The oil is neutralized with an organic amine to provide a finished product suitable for reuse as a motor oil or as a blending stock for reformulation as a motor oil.

10 Claims, No Drawings

PROCESS FOR RECLAIMING SPENT MOTOR OIL

FIELD OF THE INVENTION

This invention relates to processes for reclaiming spend motor oil.

BACKGROUND OF THE INVENTION

In the past, attempts have been made to provide a process for reclaiming used or spent motor oils obtained, for example, as the drainings from the crankcases of automobiles or trucks.

The most widely used process today for reclaiming spent motor oil involves, as an initial step, flashing the gasoline or diesel oil content which might be present in the oil. This step is followed by treating the oil with a large amount, i.e. about 10–15% by volume of concentrated (~98%) sulfuric acid thereby forming suplhonic acid derivatives of the petroleum hydrocarbons. The result of this treatment is to convert about 50% of the feed to oil-insoluble sulphonic acids that form an acid sludge referred to in the art as "green acid". This material must be discarded.

The portion of the treated feed remaining after separation from the sludge and extraction with clay is comprised of oil-soluble sulphonic acids. The clay extractant, however, is usually discarded or reactivated where feasible.

Another effect of treating the spent motor oil with the large volumes of sulfuric acid used in the prior art process is the destruction of the viscosity index improvers used in most modern motor oil formulations. These materials, referred to as V.I. improvers, are typically relatively low molecular weight polyisobutylene or polymethylmethacrylate.

Approximately half the motor oil today is so-called multi-viscosity oil, for example the commonly available SAE 10W-30 weight or IOW-40 weight oils sold in service stations. Such oils are made by formulation of a refined light neutral oil having a viscosity in the range of 90–130 SSU/100° F and 10–40% of the viscosity improvers referred to above.

Since the previously employed reclaiming process destroys the V.I. improvers, the reclaimed oil has a viscosity rating of about 20 SAE. This viscosity is too low for use as motor oil without reformation with V.I. improvers.

From the preceding discussion, it should be apparent that the prior art process of reclaiming oil involving treating it with 10–15% or more by volume of sulfuric acid is attended by serious disadvantages in that half of the spent oil feed is converted to a useless product and the viscosity improving additives are destroyed. Nevertheless, the use of this large volume of acid is required in the process in order to neutralize or destroy certain dispersant additives, principally the ashless detergent, a diester of succinic acid, used in many modern motor oils to keep particles, for example, particulate carbon, suspended in the oil during its lifetime in the crankcase. Destruction or neutralization of these additives causes the suspended particles to precipitate making their removal a convenient process.

Some of the problems associated with the process described supra are avoided by employing a more recently developed process. This process requires a vacuum distillation of the spent oil. By this technique, a light oil distillate is obtained that can be reused in motor oil. However, the bottoms in the distallation contain the polymeric V.I. improvers as well as those impurities which it is desired to remove. As a result, the distillate must be reformulated with a V.I. improver if it is to be used as a motor oil.

The limitations of the prior art processes have resulted in a situation wherein reclaimed motor oil as a blending stock to be used in the manufacture of motor oil is not an economically viable alternative to the use of virgin stock obtained as a product of refining petroleum. Therefore, there has been little economic incentive to provide facilities for collecting and reclaiming crankcase drainings. Disposal of the large quantity of this material has a significant negative impact on the environment and measurably increases the amount of petroleum that is consumed each year.

Accordingly, it is an object of this invention to provide an improved process for reclaiming spent motor oil.

Yet another object of this invention is to provide an improved stock for formulating motor oil derived from spent motor oil.

The achievement of these and other objects will be apparent to those skilled in the art when the following descriptions of the invention is considered.

SUMMARY OF THE INVENTION

According to the present invention, spent motor oil can be reclaimed by a process comprising first heating an accumulation of spent motor oil for a time sufficient to cause the precipitation of a portion of the suspended solids. After separation from these solids, the oil is treated with not more than about 6% concentrated sulfuric acid to precipitate additional solids and a "green acid" sludge. The oil is removed from the sludge and oil soluble sulphonic acids neutralized with an organic amine. The amine neutralized sulfonates function as a dispersant in the reclaimed oil as do conventional detergent additives. The resulting oil is conveniently reformulated to form a motor oil useful in internal combustion engines.

DETAILED DESCRIPTION OF THE INVENTION

The process of this invention is applicable to spent oils that contain detergent additives.

The spent motor oils that generally comprise the feed material employed in the process of this invention typically will be accumulations of drainings from the crankcases of internal combustion engines, particularly gasoline and diesel engines used in automobiles and trucks. Therefore, the spent oils actually obtained in this way will be composed of oils of diverse manufacture.

As indicated in the Background of the Invention, these oils typically contain a dispersant to keep particulates in suspension during the time during the oil is in the crankcase. The suspended solids are removed from the engine when the oil is changed. These dispersants, frequently referred to as detergents, are of two general types. One type includes the alkali metal salts, usually calcium or barium salts, of petroleum sulfonates. The other type, referred to as an ashless detergent, is a diester of succinic acid. Some oils contain dispersants of both types. Spent motor oil therefore, contains varying amounts of both.

In the prior art process, the treatment of the spent oil with large volumes of sulfuric acid is believed to accomplish two important functions with respect to these additives. The sulfonate salts are converted to free acids thereby losing their ablility to keep solids in suspension. By contrast, the ashless dispersant is destroyed and also loses its ability to suspend solids. As a result of these effects on the dispersants, the solids are precipitated and easily removed. However, as indicated in the Background of the Invention, use of the quantity of sulfuric acid necessary to effectively destroy and/or neutralize the dispersants has numerous disadvantages.

Unexpectedly it has found that the requirement of a large volume of sulfuric acid can be avoided by initially subjecting spent motor oil to a heating step, typically at least about 675° F, for a time sufficient to cause precipitation of a portion of the suspended solids. Although applicant does not wish to be bound by any particular theory, it is believed that this heating step destroys the ashless additive itself, or at least destroys its ability to maintain solids in suspension.

The effectiveness of the heating step is temperature and time dependent. Accordingly, it is presently preferred to employ temperatures in the range of from about 700°–720° F. Below 700°, the time required for effectively causing the precipitation of a substantial portion of the suspended solids is too long to be commercially attractive. Above about 725° F, oxygenated products are formed in undesirable quantities. The time required varies with temperature and can range up to several hours in duration. At 710° F, about 30 minutes of heating is sufficient.

The solids obtained by this process can be separated by simple filtration. Filtration through adsorbent agents such as clay are, of course, possible but not required. Thus, the disposal of a clay type extractant can be avoided.

Following the filtration step, the oil is contacted with concentrated sulfuric acid to substantially complete the precipitation of suspended solids. The amount employed can be less than the 10–15% by volume required by the prior art process. Preferably, to minimize or avoid the undesirable side reactions caused by sulfuric acid, particularly the destruction of the V.I. improvers, not more than about 6% sulfuric acid by volume should be employed. Best results are obtained using from about 3–6% sulfuric acid. Sulfuric acid in an amount from about 1–2% converts the alkali metal sulfonate dispersants to free acids causing the precipitation of additional solids but forms a "green acid" sludge that is heavy and difficult to pump. A more fluid sludge is obtained using about 3% by volume acid and the reclaimed oil exhibits a better color. Best color results are obtained on the drainings obtained from motor oils as conventionally formulated and marketed today by using about 4% sulfuric acid.

It will be appreciated by those skilled in the art that drainings will not be of uniform character and that for different lots of spent oil, the temperature and time of the heating step and the quantity of sulfuric acid which will give optimal results may vary within the parameters described above.

The oil remaining from the sulfonic acid treatment is separated from the sludge by any convenient technique, for example, by filtration, and its acid content, predominantly oil soluble sulphonic acids resulting from the sulfonation of some of the hydrocarbons in the oil or the sulphonic acid residues of the detergents are neutralized with an organic amine in the manner described in my copending application "Soluble Base Oil and Blends Thereof", Ser. No. 591,468, filed June 30, 1975, the disclosure of which is incorporated by reference.

Preferably sufficient amine should be employed to impart to the oil a pH of about 8. A finished oil is obtained by filtering the neutralized product through a polish filter. Suitable amines for neutralizing the sulphonic acids include those organic amines that result in an oil-soluble sulphonate. Useful amines include, but are not limited to, alkyl amines such as ethyl amine, diethyl amine, triethyl amine and the like. However, preferred amines are those that form surface active amino-sulfonates capable of forming stable normal or invert emulsions, preferably the latter, with water, i.e., oil in water or water-in-oil emulsions, as these sulfonates can function as detergent additives in the manner of the barium and calcium sulphonates referred to above thereby eliminating or minimizing the amount of detergent required for reformulating the oil. The selection of a suitable amine to achieve this character is well within the ability of those skilled in the art.

Suitable amines for this purpose include alkanol amines such as those disclosed in U.S. Pat. Nos. 1,780,144, and 2,204,326, the disclosures of which are incorporated by reference, particularly low molecular weight alkanol amines such as monoethanol amine and monoisopropanol amine. Also suited are alkylene polyamines like those described in U.S. Pat. No. 3,005,847, the disclosure of which is also incorporated by reference, including, diethylene triamine and the like. Again low molecular weight polyamines are preferred. By low molecular weight amine it is meant an amine having 6 or fewer carbon atoms.

It is presently preferred to employ higher molecular weight amines, particularly fatty acid amines of the types well known in the art to provide oils capable of forming stable invert emulsions. Such fatty acid amines include cocoa amine, soyamine, safflower amine and tall oil fatty acid amine. Particularly preferred fatty acid amines are tallow amine and tall oil amine. A commercially available tallow amine is Armour Ethomid HT/15 which is a polyoxylene [5] hydrogenated tallow amine.

To be designated an SAE-30 oil, an oil should exhibit a viscosity of between 58–70, SSU/210° F. An SAE-10W oil should have a viscosity of 6000–12000 SSU/0° F. To obtain an oil having a viscosity near the 12,000 maximum at 0° F, the oil should have a viscosity index of at least 130.

Using the process of the present invention, a reclaimed oil has been obtained, by heating at 710° F for about 30 minutes, followed by treatment with 4% by volume of sulfuric acid (98%) and neutralization with tall oil amine, having a viscosity index of about 136. The oil exhibits a viscosity of about 58 SSU/210° F and 380 SSU/100° F. These data indicate that the V.I. improver has survived the process. Though somewhat on the low end for the requirements of an SAE-30 oil, the reclaimed oil can be reformulated with 150 SSU/210° F bright stock (about 10%) to achieve an oil well within the specifications required of a SAE 10W-30 oil. Other additives conventionally employed in motor oils may also be supplied as needed or desired. The simple nature of this process lends itself to application in small plants that may be located where desired in order to minimize the costs incurred in collecting and transporting the spent oil and returning the reclaimed oil to the market place.

I claim:

1. A process for reclaiming spent motor oil comprising:

a. heating said oil for a time sufficient to precipitate a substantial portion of the suspended solids;
b. separating said solids;
c. contacting said oil with concentrated sulfuric acid in an amount effective to substantially complete the precipitation of suspended solids without destroying viscosity index improvers in the oil;
d. separating said solids; and
e. treating said oil with an organic amine to neutralize the petroleum sulfonic acids resulting from the treatment with sulfuric acid, said amine being selected to form an oil soluble amino-sulfonate.

2. A process according to claim 1 wherein said heating is in the range of 700°–720° F.

3. A process according to claim 2 wherein said temperature is about 710° F.

4. A process according to claim 1 wherein said oil is contacted with sulfuric acid in an amount between about 3 to about 6% by volume of concentrated sulfuric acid.

5. A process according to claim 4 wherein the amount of said sulfuric acid is about 4% by volume.

6. A process according to claim 1 wherein the oil is treated with the organic amine to impart to the oil a pH of about 8.

7. A process according to claim 6 wherein the amine is selected from alkanol amines, polyamines and fatty acid amines.

8. A process according to claim 7 wherein said alkanol amine is selected from monoethanol amine and monoisopropanol amine.

9. A process according to claim 7 wherein said polyamine is diethylene triamine.

10. A process according to claim 7 wherein said fatty acid amine is selected from cocoa amine, soyamine, safflower amine, tall oil amine and tallow amine.

* * * * *